US006693433B2

(12) United States Patent
Schmidt et al.

(10) Patent No.: US 6,693,433 B2
(45) **Date of Patent: *Feb. 17, 2004**

(54) SILICON OXIDE CONTAMINATION SHEDDING SENSOR

(75) Inventors: Stephan E. Schmidt, Woburn, MA (US); Kristin Powers Goppel, Shrewsbury, MA (US); Eric J. Carlson, Sudbury, MA (US)

(73) Assignee: Gas Research Institute, Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/142,031

(22) Filed: May 9, 2002

(65) Prior Publication Data

US 2002/0171432 A1 Nov. 21, 2002

Related U.S. Application Data

(63) Continuation of application No. 09/548,563, filed on Apr. 13, 2000, now Pat. No. 6,414,494.

(51) Int. Cl.[7] ..... G01N 27/62
(52) U.S. Cl. ..... 324/468

(58) Field of Search ..... 324/468, 149, 324/464, 470; 431/22, 12, 18, 350, 354, 78; 436/116, 119, 122, 154; 422/54

(56) References Cited

U.S. PATENT DOCUMENTS

| | | | | |
|---|---|---|---|---|
| 4,182,740 | A | 1/1980 | Hartmann et al. | 436/154 |
| 4,965,048 | A | 10/1990 | Ogasawara | 431/12 |
| 5,971,745 | A | 10/1999 | Bassett et al. | 436/154 |
| 6,414,494 | B1 * | 7/2002 | Schmidt et al. | 324/468 |

FOREIGN PATENT DOCUMENTS

| | | |
|---|---|---|
| DE | 195 02 900 | 8/1996 |

* cited by examiner

*Primary Examiner*—John E. Chapman
*Assistant Examiner*—James Kerveros
(74) *Attorney, Agent, or Firm*—Mark E. Fejer

(57) ABSTRACT

In a flame ionization sensor type gas combustion control apparatus, the sensor tip, or probe, exposed to the flame is constructed and arranged according to materials and shapes which promote mechanical deformation of the sensor due to thermal expansion and contraction. The mechanical deformation will cause cracks to open in the contaminant layers surrounding the probe, enabling the sensor to perform as intended even though insulative contaminant build up is present.

13 Claims, 3 Drawing Sheets

SILICON OXIDE CONTAMINATION SHEDDING SENSOR

This application is a continuation of U.S. patent application Ser. No. 09/548,563 filed on Apr. 13, 2000, now U.S. Pat. No. 6,414,494, issued on Jul. 2, 2002.

BACKGROUND OF THE INVENTION

1. Field of the Invention

The present invention relates generally to temperature probes, or sensor tips, of the type used for the control and safety monitoring of gaseous fuel burners as used in various heating, cooling and cooking appliances. In particular, the present invention relates to flame ionization sensor probes used in gas combustion control/safety environments where contamination coating of the probe shortens the useful life of the sensor.

2. Discussion of the Related Art

Flame ionization sensing provides known methods and apparatus for monitoring the presents of a flame for a gaseous fuel burner.

It is known that hydrocarbon gas flames conduct electricity because charged species (ions) are formed by the chemical reaction of the fuel and air. When an electrical potential is established across the flame, the ions form a conductive path, and a current flows. Using known components, the current flows through a circuit including a flame ionization sensor, a flame and a ground surface (flameholder or ground rod).

FIG. 1 illustrates a flame ionization sensor system 10 with a typical sensor/burner circuit loop as may be used in accordance with the present invention. Flame ionization sensor 11 having a probe 12, will be mounted near the burner 13. The output 15 of sensor 11 will be fed into a computer-controller 17. The sensor loop can provide information regarding the status of a flame 18 in the burner 13. If there is no flame, then the sensor 11 will not generate a signal which will cause the controller 17 to instruct the system to shut off fuel flow.

In utilizing a flame sensor as previously described, a voltage, such as a 120 AC voltage 21, will be applied across the sensor loop, with the flame holder, or burner 13, serving as the ground electrode 20. Flame contact between the sensor probe 12 and the burner 13 will close the circuit. The alternating current (AC) output of the sensor/ground circuit, can be rectified, if the ground electrode (flameholder or burner 13) is substantially larger in size than the positive electrode, since, due to the difference in electrode size, more current flows in one direction than in the other.

Flame ionization sensor probes 12 are thus electrodes, made out of a conductive material which is capable of withstanding high temperatures and steep temperature gradients. Hydrocarbon flames conduct electricity because of the charged species (ions) which are formed in the flame. Placing a voltage across the probe and the flameholder causes a current to flow when the flame closes the circuit.

Unfortunately it has been found that contaminants in the air stream of the fuel/air mixture can result in the build up of an insulating contamination layer on the probe, rendering it much less effective. At a certain level of coating, which prevents electron flow to the probe surface, the sensor is rendered useless, creating a premature or false system failure. Often these airborne contaminants are organosilicones found in personal and home care products which are oxidized by the flame 18 to silicon oxides (SiOx) which in turn build up through impact on the probe 12 providing the insulative contaminant coating.

It is thus desirable to find ways to increase the useful life of flame ionization sensor probes in spite of this insulative build up resulting from normal use of the flame ionization sensor system.

SUMMARY OF THE INVENTION

According to one embodiment of the present invention, the fact that the sensor tip, or probe, is exposed to the flame is taken advantage of and the probe is constructed and arranged according to materials and shapes which promote mechanical deformation of the sensor tip due to thermal expansion and contraction. Sufficient mechanical deformation will cause cracks to open in the contaminant layer surrounding the probe, breaking the insulative effect and allowing ions from the flame through to the probe thereby enabling the sensor to perform as intended even though insulative contaminate build up is present. The mechanical deformation may be sufficient to allow the probe to shed contaminant build up. The material of the probe will thus be selected to have a coefficient of thermal expansion (CTE) over the operating temperature range of the probe sufficient to allow such cracking or shedding of the contaminants to occur. Bimetal construction of the probe is a contemplated embodiment. Specially shaped probes such as helical, or corrugated shapes may be utilized in conjunction with material selection to further aid in contaminant layer cracking or shedding. Finally, some gain in contaminant build up prevention may also be had by specially shaping the probes to minimize SiOx particle impact on the probe.

BRIEF DESCRIPTION OF THE DRAWINGS

The above-mentioned and other features and objects of this invention will be better understood from the following detailed description taken in conjunction with the drawings wherein.

DETAILED DESCRIPTION OF THE PREFERRED EMBODIMENTS

As mentioned above, the primary cause of failure for flame ionization sensors is believed to be SiOx contamination insulation of the sensor probe, which is exposed to the flame. The SiOx contamination problem was studied by accelerated life testing of an flame ionization sensor in various furnace units by introduction of organosilicone contaminants into the burner air stream through a compressed air bubbler. Dow 344 fluid available from Dow Chemical Co., consisting of ninety percent Dow D4 fluid and ten percent Dow D5 fluid was used in the contaminant vaporization apparatus. The organosilicones are oxidized in the burner flame to silicon oxides (SiOx) which are deposited by impact on the sensor probe surfaces. The baseline probe referred to herein for comparison purposes with the present invention is a straight piece of round sensor stock material of about ⅛ inch diameter. While the results mentioned are the result of the accelerated life testing, it is believed that all results may be validly extrapolated to the real time phenomena of flame ionization sensor failure.

It has been found that a rapid deposition of an initial SiOx layer takes place. This initial SiOx contaminant layer covered, or insulated, most of the effective probe surface; i.e., SiOx contamination is locally concentrated at points where the flame front contacts the sensor. However the contaminant layer contained gaps allowing charge to flow to the conductive rod surface, thereby producing enough current flow to allow operation of the flame ionization sensor control or safety system.

A relatively high percentage of the subsequent contamination settled on the initial SiOx layer. Smaller amounts of contamination eventually find their way into the gaps of the initial contamination layer thus leading to a gradual decay in signal proportional to the rate at which the gaps were filled. Because gaps in the complete coverage of the contaminant layer allow access by charged particles to the surface of the probe, it was found that constructing a probe to affect mechanical distortion of the probe and thereby crack, or even shed, at least some of the contamination layer would allow great increase in the useful life of the sensor apparatus, necessitating many less field repairs.

Figure 1:
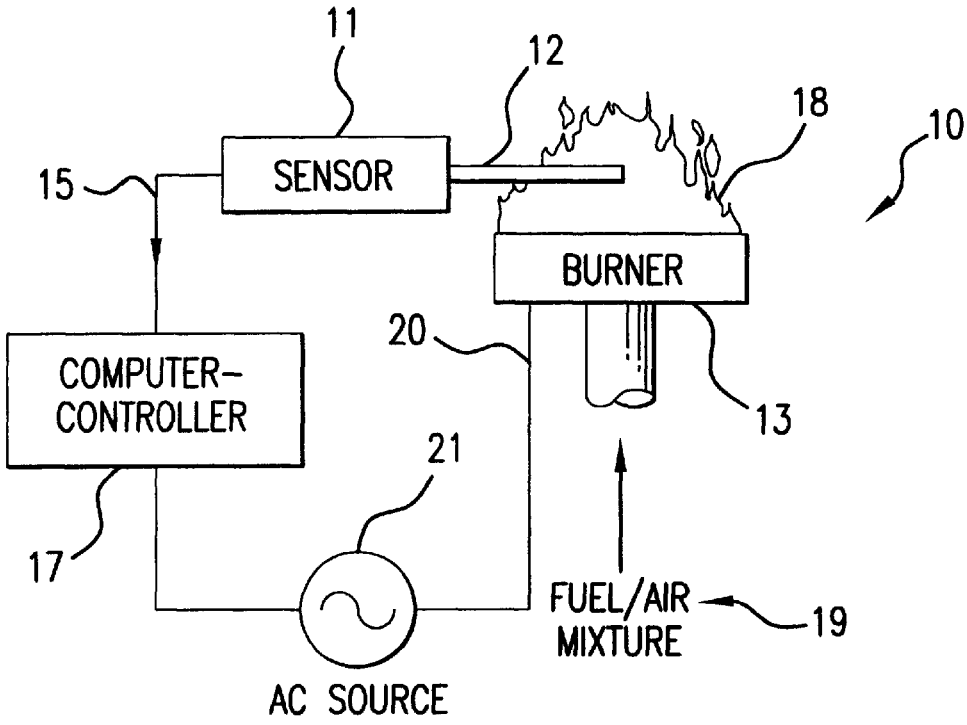
FIG.1 PRIOR ART
FIG. 1 illustrates the known arrangement of components for explanation of a flame ionization sensor circuit.
Figure 2:
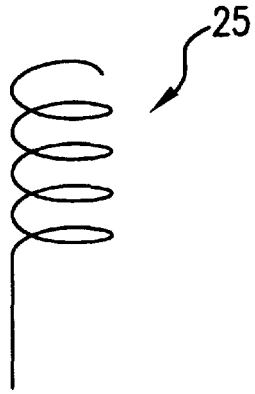
FIG. 2 illustrates a regular helix shaped sensor according to the present invention.

Referencing FIG. 2, a sensor probe was constructed as a regular helix, or coil, 25 of straightened seven gage Kanthal D stock wire, a known probe material of about 70 percent iron with the balance being largely chromium and aluminum. Kanthal D is a trademark of Kanthal AB of Sweden. The exact material is not critical to the present invention and may be selected from the group of known probe materials such as Kanthal D, stainless, and hoskins. Gage, and overall size of the probe will, of course, be dependent on application of the probe, e.g., commercial, industrial, residential, etc. Kanthal D has a coefficient of thermal expansion (CTE) over the operating range of the burner as follows:

| | |
|---|---|
| 68–480° F. = | 11 × 10–6 |
| 68–930° F. = | 12 × 10–6 |
| 68–1380° F. = | 14 × 10–6 |
| 68–1830° F. = | 15 × 10–6 |

For present discussion purposes the overall figure of $15\times10^{-6}$ inches/° F. over 68–1830° F. representing a change of 0.026 or 1/40 inch over the thermal cycle of a typical 1.5 inch coil length will be used.

Figure 3:
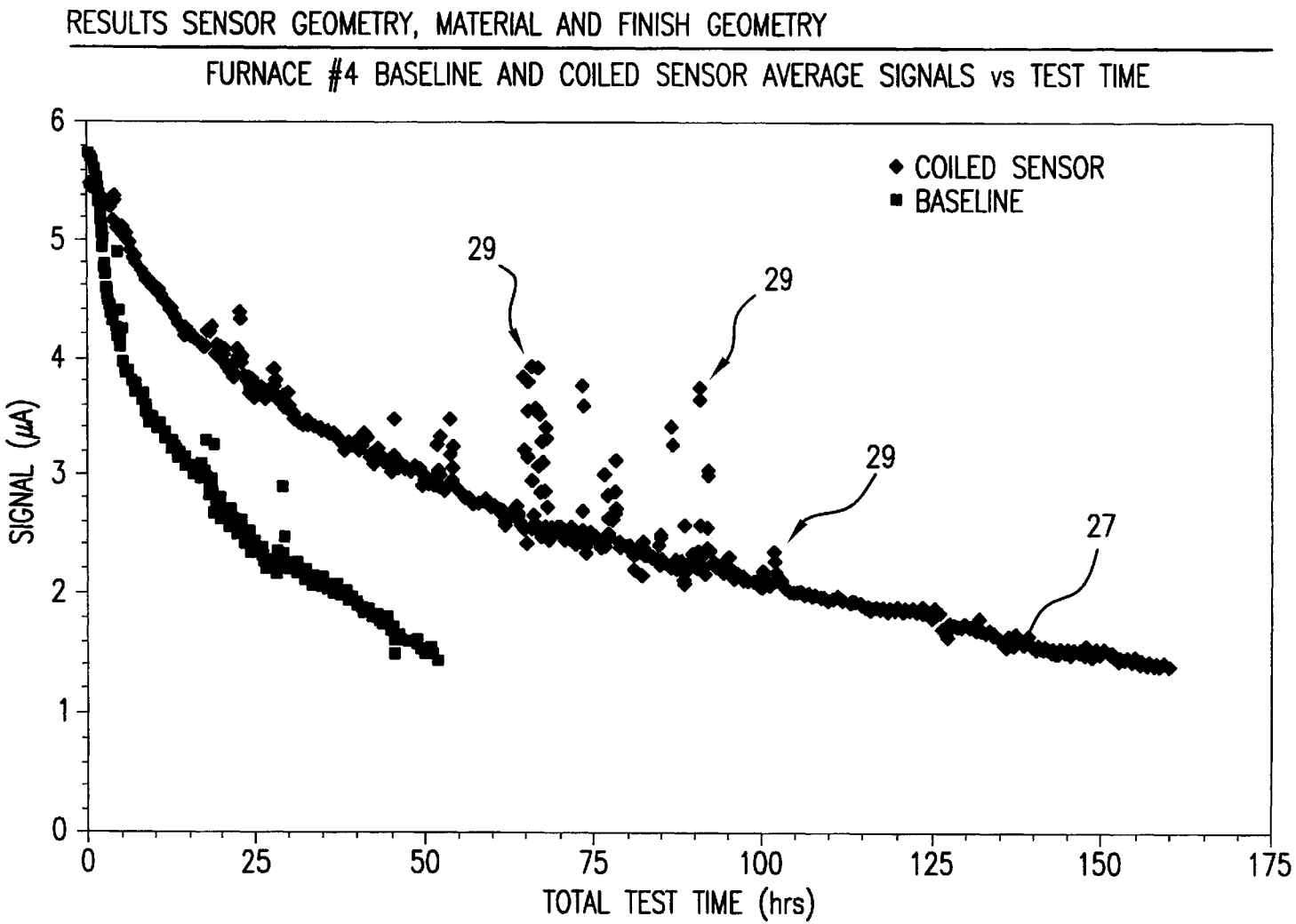
FIG. 3 is a graph showing the improved lifespan of the probe embodiment of FIG. 2.

FIG. 3 illustrates the 310 percent increase in time to failure of the probe of FIG. 2 as compared to a baseline sensor of straight wire and the same material used in the same in-shot type burner from a residential furnace platform. The signal line 27 of the present invention shows spikes, collectively 29, believed to represent significant cracking of the contaminant coating allowing signal strength to jump appreciably before the cracks are refilled with new contaminants.

Figure 4:
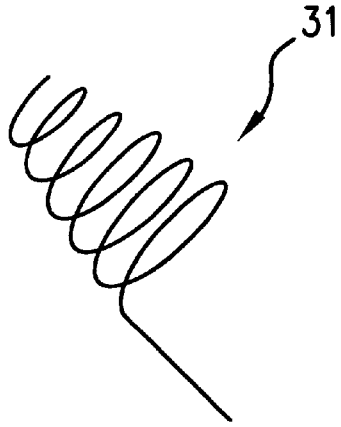
FIG. 4 illustrates a conical helix shaped sensor according to the present invention.

While testing was done with the regular diameter coil of FIG. 2, it is envisioned that other shaped probes may induce adequate mechanical distortion to produce cracking of the contaminant layer in order to increase the time to failure of the sensor unit. FIG. 4 shows an alternative embodiment of coiled probe in which the probe is a conically shaped helix 31.

Figure 5:
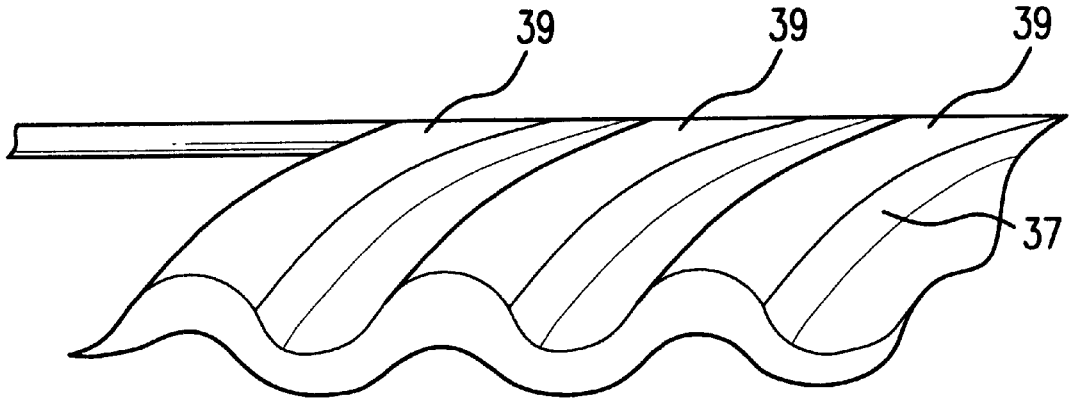
FIG. 5 illustrates a corrugated and wing-shaped sensor according to the present invention.

Referencing FIG. 5, the shape of the probes may also be combined with other factors, beyond CTE of the material, to produce enhanced time to failure characteristics of the sensor unit. In testing, a wing-shaped body with the leading edge width being thirty percent of the baseline probe diameter and the depth (cord) being 180% of the baseline probe diameter was tested on the theory that the wing shape would allow the SiOx contaminant particles to blow by the probe resulting in less contaminant build up per unit time. In the embodiment of FIG. 5 the wing shape sensor body 37 has been pressed to produce sine wave corrugations, collectively 39. "Corrugations" as used herein is not meant to encompass essentially two dimensional bending such as may be done to a single wire. Testing of the wing shaped body showed a twenty five percent improvement in life of the probe. Combining the wing shape with corrugations is theorized to produce the benefits of both the mechanical distortion producing corrugation shape and the low contaminant build up shape. Additional considerations affecting contamination build up such as smooth surface finish and negative polarity of the probe within the sensing circuit may further be combined with the present invention to additionally enhance probe lifespan.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A probe for a flame ionization sensor comprising:

a mechanically deformable material having a shape suitable under normal use of said probe for cracking at least one insulative contaminant covering disposed on said probe.

2. A probe in accordance with claim 1, wherein said mechanically deformable material has a coiled shape.

3. A probe in accordance with claim 1, wherein said mechanically deformable material has a corrugated shape.

4. A probe in accordance with claim 1, wherein said mechanically deformable material has a winged shape.

5. A probe in accordance with claim 1, wherein said mechanically deformable material is selected from the group consisting of KANTHAL D, stainless steel and hoskins.

6. A probe in accordance with claim 1, wherein said mechanically deformable material is a bimetal.

7. A probe in accordance with claim 1, wherein said mechanically deformable material has a shape with a reduced frontal impact area.

8. In a flame ionization sensor having a probe, the improvement comprising:

said probe comprising a mechanically deformable material having a shape suitable in normal use for cracking at least one insulative contaminant covering disposed on said probe.

9. A flame ionization sensor in accordance with claim 8, wherein said shape is coiled.

10. A flame ionization sensor in accordance with claim 8, wherein said shape is corrugated.

11. A flame ionization sensor in accordance with claim 8, wherein said shape has a reduced frontal impact area.

12. A flame ionization sensor in accordance with claim 8, wherein said mechanically deformable material is selected from the group consisting of KANTHAL D, stainless steel and hoskins.

13. A flame ionization sensor in accordance with claim 8, wherein said mechanically deformable material is a bimetal.

* * * * *